United States Patent [19]

Clement

[11] Patent Number: 4,843,402

[45] Date of Patent: Jun. 27, 1989

[54] AZIMUTH ARRAY OF ROTORY ANTENNAS WITH SELECTABLE LOBE PATTERNS

[75] Inventor: A. J. F. Clement, McFarland, Calif.

[73] Assignee: Tri-ex Tower Corporation, Visalia, Calif.

[21] Appl. No.: 879,383

[22] Filed: Jun. 27, 1986

[51] Int. Cl.[4] ..... H01Q 3/04

[52] U.S. Cl. ..... 343/758; 343/844; 343/853; 342/375

[58] Field of Search ..... 343/758, 757, 766, 844, 343/853, 824, 876, 893; 342/368, 371, 372, 374, 375

[56] References Cited

U.S. PATENT DOCUMENTS

| | | | |
|---|---|---|---|
| 2,227,563 | 1/1941 | Werndl | 343/758 |
| 4,063,250 | 12/1977 | Fenwick | 343/844 |
| 4,122,447 | 10/1978 | Kawai et al. | 343/853 |

*Primary Examiner*—William L. Sikes
*Assistant Examiner*—Michael C. Wimer
*Attorney, Agent, or Firm*—William H. Drummond

[57] ABSTRACT

A radio transmission antenna system and method of transmitting radio signals.

The antenna system includes an array of separately rotatable directional antennas which are spaced along an azimuth line. The antennas are rotated to direct their respective major lopes of transmitted rf energy along parallel lines in a selected direction relative to the azimuth line. Two separate adjustments are made to the phase of identical rf signals which are fed to each antenna in the array.

A first phase adjustment is made when required to produce a coherent wave-front transmitted in the selected direction. This first phase adjustment shifts the phase of the signals fed to adjacent antennas in the array by 180°. This adjustment establishes a radiation pattern in any given azimuth quadrant which records major lobes, established by rotating the antennas, at 0° and 90° relative to the azimuth line and at least one intermediate angle between 0° and 90°. The second adjustment changes the phase of the signals fed to antennas which are spaced equally from the geographic center of the array by equal, opposite magnitudes. This second adjustment electrically wobbles the direction of the major lobe on either side of the direction established by the first adjustment.

A method of operating the above-described array includes the steps comprising the spacing and phase adjustments described above.

2 Claims, 4 Drawing Sheets

FIG. 1
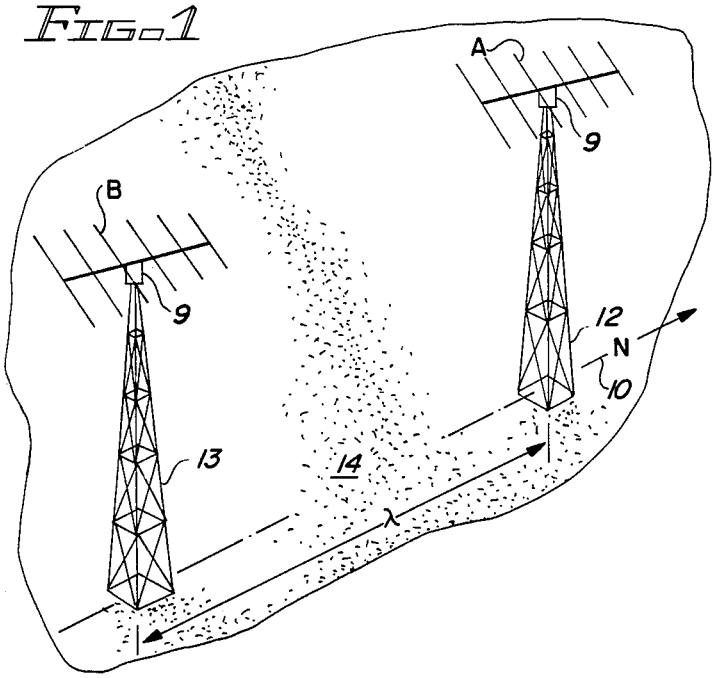
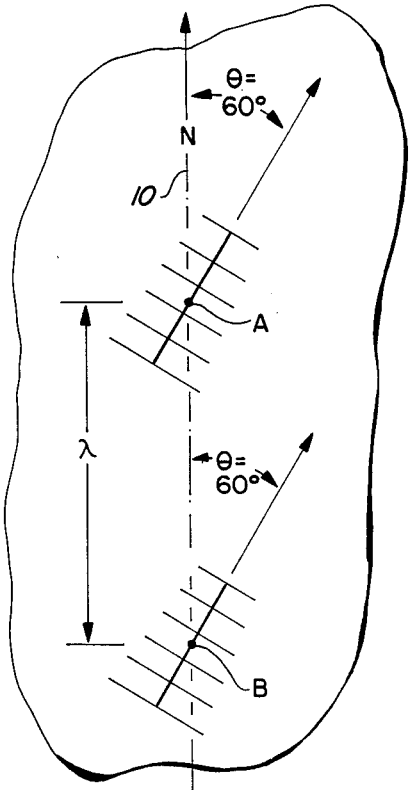
FIG. 2
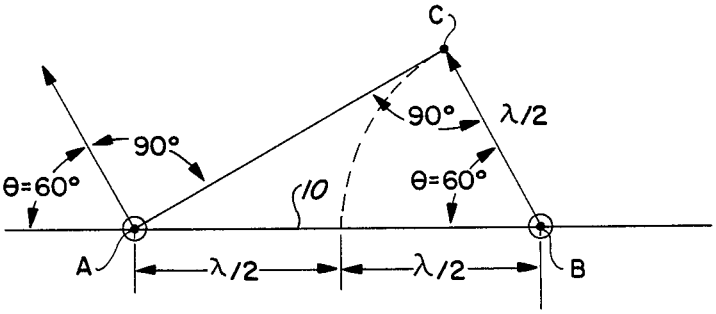
FIG. 3
FIG. 4
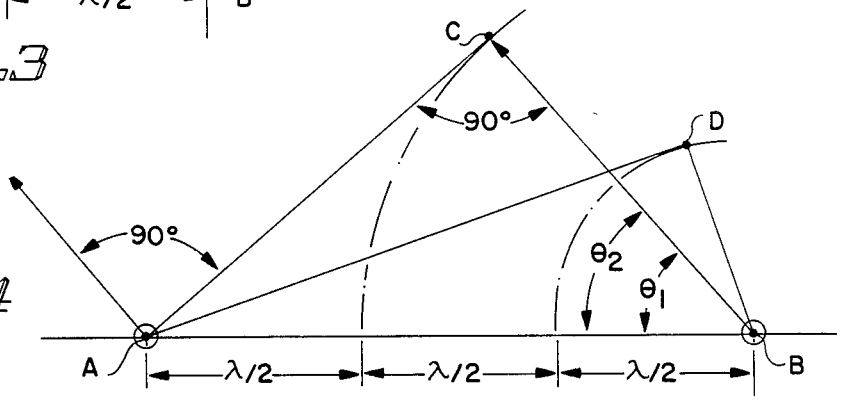
FIG. 5
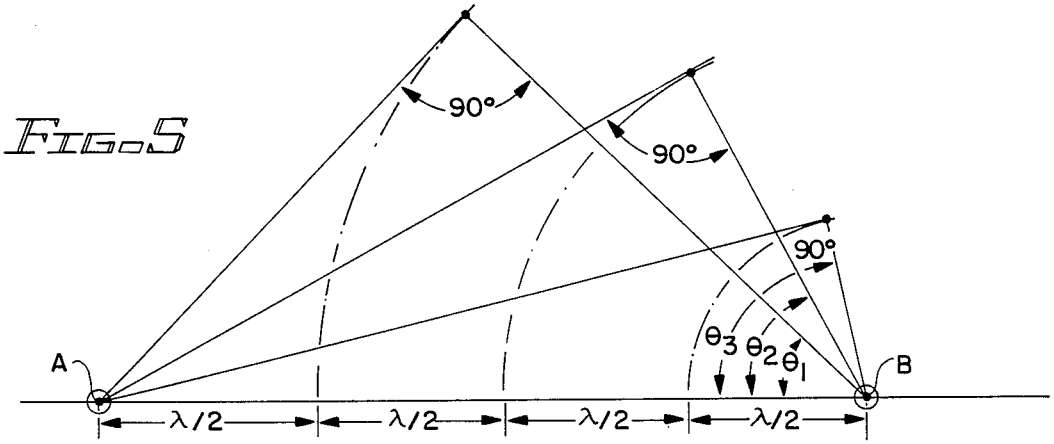

FIG. 6
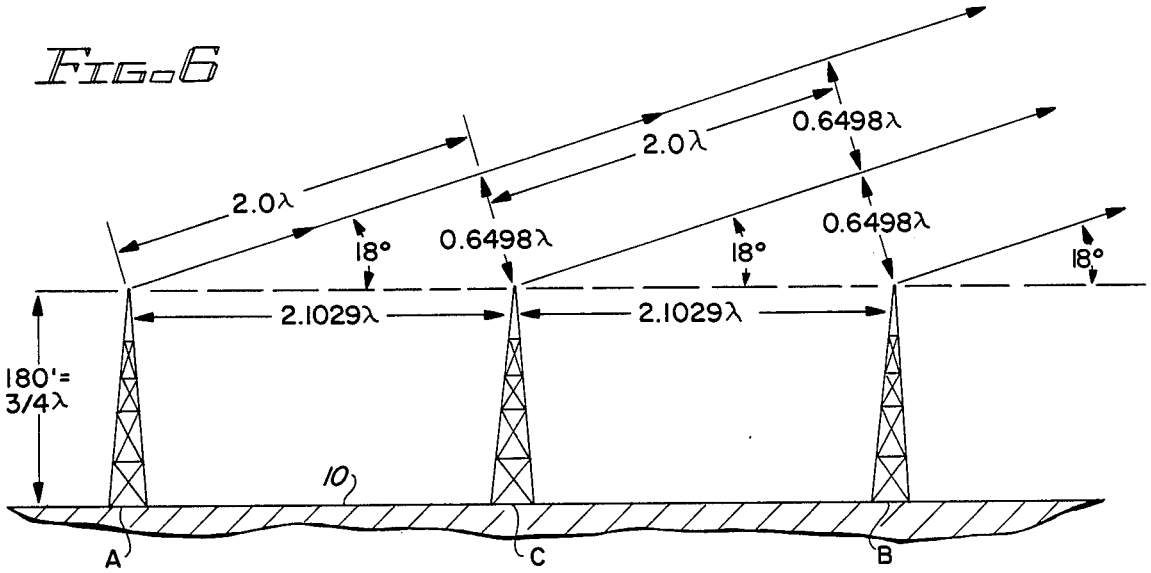
FIG. 7
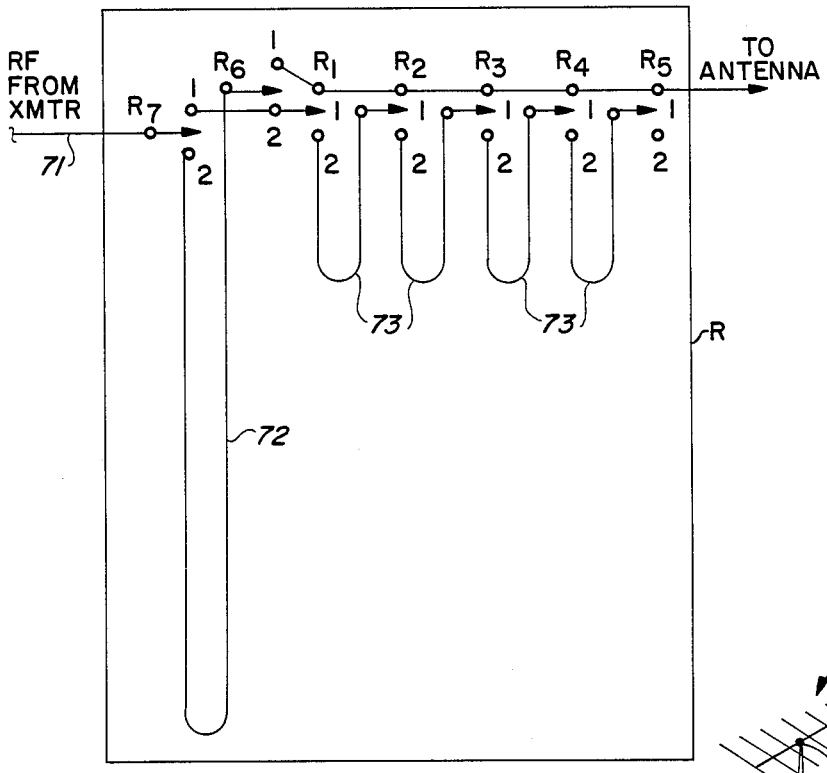
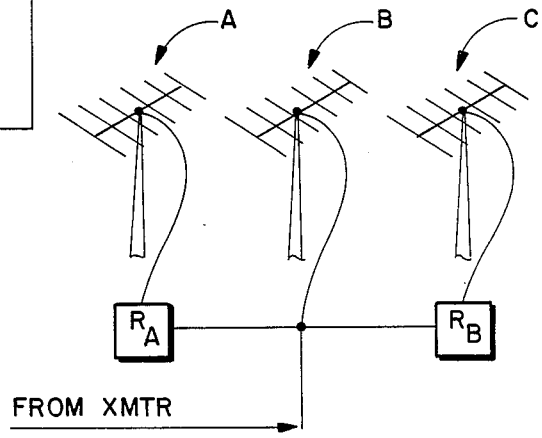
FIG. 8

PHASE-ANGLES AND RELAY SETTINGS

| HORIZ. COMPONENT AZIMUTH-ANGLE θ | ANT. "A" PHASE (DEGREES) | ANT. "B" PHASE (DEGREES) | DELAYS-SETTINGS, ANT. "A" 1 2 3 4 5 6 7 | DELAYS-SETTINGS, ANT. "B" 1 2 3 4 5 6 7 | TOTAL (A+B) PHASE |
|---|---|---|---|---|---|
| θ16 (EAST) = 90.00° | -0- | -0- | 1 - - - - - 1 | 2 2 2 2 1 2 2 | -0- |
| θ15 = 86.42° | -22.5 | +22.5 | 2 1 - - - - 1 | 2 2 2 1 - 2 2 | 45° |
| θ14 = 82.80° | -45.0 | +45.0 | 2 2 1 - - - 1 | 2 2 1 - - 2 2 | 90° |
| θ13 = 79.19° | -67.5 | +67.5 | 2 2 2 1 - - 1 | 2 1 - - - 2 2 | 135° |
| θ12 = 75.50° | -90.0 | +112.0 | 1 - - - - 2 2 | 2 2 2 2 1 - 1 | 180° |
| θ11 = 71.79° | -112.5 | +112.0 | 2 1 - - - 2 2 | 2 2 2 1 - - 1 | 225° |
| θ10 = 68.00° | -135.0 | +135.0 | 2 2 1 - - 2 2 | 2 2 1 - - - 1 | 270° |
| θ9 = 64.06° | -175.5 | +157.5 | 2 2 2 1 - 2 2 | 2 1 - - - - 1 | 315° |
| θ8 = 60.00° | 180.0 | 180.0 | 2 2 2 2 1 2 2 | 1 - - - - - 1 | 360° |
| θ7 = 55.77° | +22.5 | -22.5 | 2 2 2 1 - 2 2 | 2 1 - - - - 1 | 405° |
| θ6 = 51.30° | +45.0 | -45.0 | 2 2 1 - - 2 2 | 2 2 1 - - - 1 | 450° |
| θ5 = 46.57° | +67.5 | -67.5 | 2 1 - - - 2 2 | 2 2 2 1 - - 1 | 495° |
| θ4 = 41.40° | +90.0 | -90.0 | 2 2 2 2 1 - 1 | 1 - - - - 2 2 | 540° |
| θ3 = 35.66° | +112.5 | -112.5 | 2 2 2 1 - - 1 | 2 1 - - - 2 2 | 585° |
| θ2 = 29.00 | +135.0 | -135.0 | 2 2 1 - - - 1 | 2 2 1 - - 2 2 | 630° |
| θ1 = 20.36° | +157.5 | -157.5 | 2 1 - - - - 1 | 2 2 2 1 - 2 2 | 675° |
| θ0 (NORTH) = -0- | 180.0 | 180.0 | 1 - - - - - 1 | 2 2 2 2 1 2 2 | 720° |

NOTE: TRANSMISSION LINE TO ANTENNA "A" IS 1/4 λ LONGER THEN TO MIDDLE ANTENNA. ALSO, LINE TO ANTENNA "B" IS 1/4 λ SHORTER THAN TO MIDDLE ANTENNA.

FIG. 9

AZIMUTH ARRAY OF ROTORY ANTENNAS WITH SELECTABLE LOBE PATTERNS

FIELD OF THE INVENTION

This invention pertains to radio transmission antenna systems and methods of operation thereof.

More particularly, the invention concerns a line array or rotary antennas which provides a plurality of selectable major lobes of transmitted rf energy to provide for substantially continuous optimum transmission in any selected direction while concomitantly providing gain in the selected direction.

According to another aspect of the invention, the invention relates to an rf transmission antenna system and method which is especially adapted to transmitting signals from an array of large Yagi or quad antennas, which, because of their physical dimensions, are impractical to employ in conventional "stacked" arrays.

In still another respect, the invention pertains to a method of operating a line array of rotatable directional antennas to provide selectable, directive major lobes of transmitted rf energy in a plurality of directions between the two "end-fire" and the two "broadside" directions.

DESCRIPTION OF THE PRIOR ART

Rf transmitting antennas which exhibit both directivity and gain in comparison to an isotropic radiator are well-known in the art. For example, such directive gain antennas include the familiar simple dipole as well as the so-called Yagi beams, quad beams and the like.

It is also known to "stack" directional antennas vertically on a rotatable common mast or horizontally on a common rotatable boom. Separate rf signals are fed to the separate antennas in such stacked arrays and the individual signals transmitted from each antenna in the array add to form a common far field wave front to produce a gain in signal strength above that which is transmitted from each individual antenna in the array.

According to the prior art, the entire vertically or horizontally stacked arrays are mechanically rotated about a common vertical axis to orient the major lobes of the individual antennas in the same azimuthal direction. This expedient works very well for antennas which are designed to transmit at wavelengths as short as approximately 10 meters and shorter, because the physical size of the individual antennas is relatively small and it is convenient to support a plurality of such relatively small antennas on common booms and masts. However, at lower frequencies (longer wavelengths) the physical size of the antenna elements becomes so large as to render conventional "stacking" techniques impractical. For example, a half-wavelength dipole or the driven element of a Yagi beam designed for transmitting a signal at 3.8 MHz is approximately 128 feet long. While full half-wave Yagi beams have been constructed and used for transmitting such signals, their huge size makes it completely impractical to "stack" these antennas according to common prior art practice. Even at much shorter wavelengths, for example in the range of 40 or even 20 meters, stacking Yagi and other multi-element beam antennas present a considerable structural problem, owing to the fact that, for best results, the array should be supported at least one full wavelength above the ground and preferably higher. Further, rotation of a stacked array of such antennas about a common vertical axis is also a significant structural and mechanical problem at and below transmitting frequencies of approximately 14 MHz.

It would be highly advantageous to provide an antenna system and method of operation thereof in which an array of individually supported rotatable directional antennas such as Yagis could be constructed and operated to provide at least the gain and directivity of smaller antennas "stacked" in accordance with the practice of the prior art.

Accordingly, a principal object of the present invention is to provide apparatus for transmitting radio signals.

Another principal object of the invention is to provide methods for transmitting radio signals.

Yet another object of the invention is to provide such methods and apparatus used therein by which rf signals can be transmitted with gain and directivity at least comparable to prior art "stacked" arrays while avoiding major practical structural and mechanical problems associated with constructing such prior art stacked arrays.

These and other, further and more specific objects and advantages of the invention will be apparent to those skilled in the art from the following detailed description thereof, taken in conjunction with the drawings, in which:

BRIEF DESCRIPTION OF THE DRAWINGS

FIG. 1 is an elevation view of a simplified version of an antenna system comprising two tower-supported Yagi antennas, arrayed in accordance with the invention, such simplified version being chosen for purposes of illustrating and explaining the invention;

FIG. 2 is a plan view showing the antennas of the system of FIG. 1, shown rotated to transmit their respective major lobes along parallel lines at a selected direction relative to the azimuth line running through their axes of rotation;

FIG. 3 is a diagram illustrating the operation of the simplified array of FIGS. 1–2;

FIGS. 4 and 5 are diagrams which illustrate the change in radiation patterns which are obtained by spacing the antennas of FIGS. 1–3 apart by additional half-wavelengths;

FIG. 6 is a perspective view of a three-Yagi array constructed and operated in accordance with the principles of the invention, shown in "end-fire" orientation;

FIG. 7 is a diagram of a phase adjustment relay system for one of the antennas of the array of FIG. 6;

FIG. 8 is a schematic showing the electrical arrangements of the components of the array of FIG. 6;

FIG. 9 is a table showing the angular orientation of the major lobes in one quadrant and the phase angles and relay settings used to establish such lobes by means of the methods and apparatus depicted in FIGS. 6–8;

SUMMARY OF THE INVENTION

Figure 10:
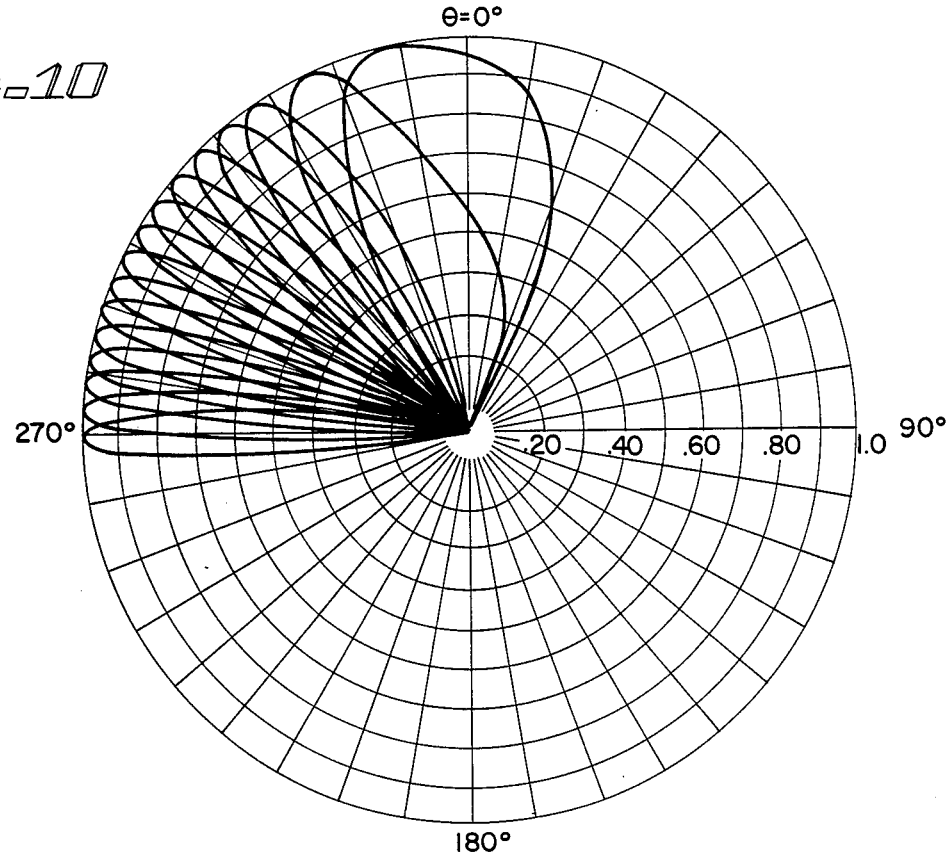
FIG. 10 is a graphical depiction of the horizontal radiation patterns of the system of FIGS. 6–9.

Briefly, I provide an antenna system and method of operation thereof in which separately supported rotatable directional antennas are disposed as an array to provide at least the gain and directivity of similar antennas which are arrayed by conventional stacking.

In accordance with one embodiment of my invention I provide a radio transmission antenna system comprising an array of rotatable directional antennas, means for separately rotating each antenna and means for providing first and second adjustments of the phase of identical rf signals fed to each antenna of the array.

The antennas which are arrayed in accordance with the invention are spaced apart S half-wavelengths at a characteristic design frequency, along a geographical azimuth line, where S is a positive integer at least equal to 2. The unit antennas of the array are rotatable to direct their respective major lobes of transmitted rf energy along parallel lines in a selected direction relative to the azimuth line. A first phase adjustment is made, when required, to produce a coherent wave-front transmitted in the selected direction. This adjustment is 180 electrical degrees in the phase of the signals fed to adjacent antennas in the line-array. This first phase adjustment establishes a radiation pattern in any given quadrant consisting of selectable major lobes which are centered on azimuth directions, as follows:

(a) the two quadrant limits of 0° and 90°, and (b) at least one intermediate angle between the quadrant limits.

A second phase adjustment is also made to the rf signals fed to the antennas of the array. By this second adjustment, the phase of the signals fed to antennas which are spaced equally from the center of the array is adjusted in equal and opposite magnitudes. For example, considering the pair of antennas located closest to the center of the array and spaced on either side thereof, the phase of the signal fed to one of this pair is adjusted in the leading directionand the phase of the signal fed to the other of this pair is adjusted by an equal magnitude in the lagging direction. This second adjustment provides for electrically wobbling the direction of the main lobe of the coherent wave-front established by the first adjustment.

In accordance with another preferred embodiment of my invention, I provide a method of transmitting radio signals by an array of rotatable directional antennas which are spaced along a geographic azimuth line. Such array includes means for separately rotating the unit antennas to direct their major lobes of transmitted rf energy along parallel lines in a selected direction relative to the azimuth line.

The method of this embodiment of the invention includes the steps, in combination, of spacing the individual antennas of the array apart by S half-wavelengths at a characteristic design frequency of ($S \geqq 2$) and providing two adjustments of the phase of separate, identical rf signals fed to each unit antenna of the array.

This first adjustment step comprises a change of phase of 180 electrical degrees difference between the signals fed to adjacent antennas of the array. This adjustment is made, when required, to establish a radiation pattern in a given azimuthal quadrant which consists of major lobes centered on azimuthal directions as follows:

(a) the quadrant limits of 0° and 90°, and (b) at least one intermediate angle between the quadrant limits.

A second phase adjustment is also made to the rf signals fed to the antennas of the array. By this second adjustment, the phase of the signals fed to antennas which are spaced equally from the center of the array is adjusted in equal and opposite magnitudes. For example, considering the pair of antennas located closest to the center of the array and spaced on either side thereof, the phase of the signal fed to one of this pair is adjusted in the leading direction and the phase of the signal fed to the other of this pair is adjusted by an equal magnitude in the lagging direction.

DESCRIPTION OF THE PREFERRED EMBODIMENT

Turning now to the drawings, FIG. 1 depicts a simple arrangement of two standard Yagi antennas A and B, each separately supported by towers 12 and 13 at three-quarters wavelength ($\frac{3}{4}\lambda$) above the ground 14. The antennas A and B are each rotatable, e.g., by rotors 9, in the horizontal plane about the vertical axes of the towers 12 and 13. These axes of rotation are spaced apart one wavelength ($\lambda$) on an azimuth line which is shown by the arrow 10, for example, as a north-south line.

For purposes of illustration of the principles of the present invention it is assumed that the antennas of FIG. 1 are fed precisely in phase. As shown in FIG. 1, the antennas are shown in so-called "end-fire" orientation, i.e., each pointed due north along the north-south azimuth line 10. Those skilled in the art will readily understand that the signals from each of the antennas A and B will add in this end-fire orientation to produce a common wave-front formed of the additive signals from each of the antennas A and B. This common wave-front will have a higher rf energy level than either of the signals generated by each of the separate antennas A and B. This "gain" will be approximately 3dB. Thus, if each of the antennas A and B exhibits 7dB gain over a simple diode at the same height, the "gain" of the two Yagis in end-fire array will be $7+3=10$dB.

Similarly, those skilled in the art will also understand that, if these antennas of FIG. 1 are rotated to fire broadside to the azimuth line 10 (e.g., due east) and if they are fed precisely in-phase, the same array-effect additive gain will be obtained.

FIG. 2 illustrates the antennas of FIG. 1, each shown rotated 60° from the north-south azimuth line 10.

Referring also to FIG. 3, which diagrammatically depicts the operation of the array of FIG. 2, and assuming that the two antennas A and B are fed 180° out of phase, it is apparent that during one half cycle, a wave will progress from antenna B a distance of half wavelength (indicated by the partial circle centered at (B) as represented by the arrow BC. The line AC, tangent to the circle represents the wave-front, since both Yagis are firing exactly perpendicular to this line. A wave arriving at C from antenna B will have the same phase as a wave just starting to leave antenna A. Thus, the two antennas, A and B, working together, produce an additive, common wave-front represented by the line AC. This composite (coherent) wave will now progress outward in a direction perpendicular to line AC.

The angle at which this additive wavefront is formed can be determined geometrically from the formula $$\theta = \cos^{-1}\frac{\lambda/2}{\lambda/2+\lambda/2} = \cos^{-1} 0.5 = 60° \qquad [1]$$

Thus, it is apparent that two directive rotary antennas such as Yagis can be positioned for complete array-effect additive gain at 0° azimuth if they are fed in phase, at 60° if they are fed 180° out of phase and at 90° if they are exactly in phase.

Additional angles of orientation of the two antennas at which additive gain is achieved are obtained by separating the antennas by additional half-wavelengths. This is illustrated in FIG. 4 which depicts the antennas A and B separated three half-wavelengths. The angles $\theta$ of the additive gain are obtained geometrically $$\theta_1 = \cos^{-1}\frac{2\lambda}{3\lambda} = 48.19° \quad [2]$$

$$\theta_2 = \cos^{-1}\frac{\lambda}{3\lambda} = 70.53° \quad [3]$$

Now, turning to FIG. 5, the antennas A and B are separated by four half-wavelengths and the angles between 0° and 90° azimuth at which additive gain is obtained are $$\theta_1 = \cos^{-1}\frac{3\lambda}{4\lambda} = 41.41° \quad [4]$$

$$\theta_2 = \cos^{-1}\frac{2\lambda}{4\lambda} = 60° \quad [5]$$

$$\theta_3 = \cos^{-1}\frac{1\lambda}{4\lambda} = 75.52° \quad [6]$$

In fact, the number of discrete angles at which complete array effect additive gain is obtained is related to the spacing between the antennas by the equation $$N=S-1 \quad [7]$$

where S is the number of half-wavelengths between the antennas. In addition, as previously indicated, this effect is also obtained at 0° and 90° .

The magnitude of the gain effect which can be achieved is increased by placing addition antennas along the azimuth line. For example, an array of four antennas (twice the number in the two antenna array) produces an additional 3dB gain, i.e., $$(7+3)+3=13 \text{ dB} \quad [8]$$

The effect of spacing the antenna further apart (by additional half-wavelengths) to obtain additional transmitting directions (major lobes) will also, however, reduce the half-power beam width of these major lobes. For example, at a spacing between the antennas of three full wavelengths (six half-wavelengths), the beam width of the major lobe broadside to the azimuth line is only 8°. Thus, large gaps in azimuth are not covered by major lobes. In order to cure this situation and produce optimum coverage, a technique of wobbling is also employed in the practice of my invention. By this technique, the effective direction of the azimuth line along which the antennas are spaced is electrically "rotated" clockwise and counterclockwise about the center point of the elongate array. This is accomplished electrically by advancing and delaying, by equal magnitudes, the phase of the separate rf signals which are fed to antennas spaced equidistant from the center point of the array. For example, in a line-array of three antennas as depicted in FIG. 6 the equal, opposite phase adjustments are applied to the end antennas A and B. No phase adjustment is applied to antenna C to achieve the wobbling effect. To illustrate this concept, assume that the array of FIG. 6 is located in central California and the azimuth line 10 of the array of FIG. 6 is oriented east-west. The main lobe in the broadside direction is oriented exactly true north. A 10° counterclockwise rotation of the line 10 would cause this broadside lobe to fire on Bombay, India while a 10° rotation clockwise would target northern Europe. Note that this electrical wobbling effect is obtained solely by phase adjustments of the signals fed to the end antennas of the array, without steering the antennas mechanically. By this wobbling technique, then, one can electrically shift the direction of the main lobe on either side of the several discrete directions which are determined by the physical spacing and turning of the antennas and the primary phase adjustments, described above.

These second phase adjustments, for wobbling the main lobe about its natural direction established by the first phase adjustment and separation of the antennas can be accomplished by any suitable technique, several of which are well-known in the art. For example, in the presently preferred embodiment of the invention, these second phase adjustments can be accomplished by inserting fractional wavelength delay-line sections in the rf transmission lines to the affected antennas. This can be accomplished by the technique illustrated in FIGS. 7–8. As shown in FIG. 8, the two end antennas A and B are fed through relay boxes $R_A$ and $R_B$, while the center antenna C is fed directly as the pivot antenna. Details of the system for matching the antenna feed impedance to the transmitter output impedance have been omitted from FIG. 8 for purpose of clarity of illustration. These details of impedance matching will be readily apparent to those skilled in the art and, for example, will be found in my article entitled "LARAE - Line Array of Rotary Antennas in Echelon" appearing in Volume 1 of the ARRL Antenna Compendium, page 72 (ARRL, 1985). Further, details of the first phase adjustment (antenna spacing and turning), as described above, have also been omitted for clarity of illustration. These details will also be apparent to those skilled in the art from the above description and are also included in my above-referenced article.

The construction of the phase adjusting relay systems $R_A$ and $R_B$ is depicted in FIG. 7. As shown in FIG. 7, the rf fed from the transmitter 71 can be switched by means of relays $R_{1\theta R7}$ through a ¼ wavelength section of transmission line 72 and a plurality of 1/16 wavelength sections 73 to cause the desired equal, opposite phase adjustments in the end antenna A. Another relay system would similarly control the phase of the signals to antenna B.

FIG. 9 is a table depicting the relationship of phase-angles and relay settings for the system of FIGS. 6–8. This table shows how, by a combination of first and second phase adjustments, it is possible to obtain 16 horizontal azimuth angles in each quadrant along which a main lobe (complete additive array gain) can be directed, using the combined mechanical-electrical steering/wobbling technique of the present invention. This array pattern is depicted graphically in FIG. 10 which shows the major lobes in the fourth quadrant.

The 16 selectable main lobes provided by the system of FIGS. 6–10 give excellent pattern overlapping such that there is never a drop in the far-point field strength versus beam heading of more than 2dB. This practical array shows a gain of approximately 12dB over 360° of azimuth in a stepwise manner that approaches the "all azimuths available" advantage of a single Yagi rotary-beam antenna.

Figure 11:
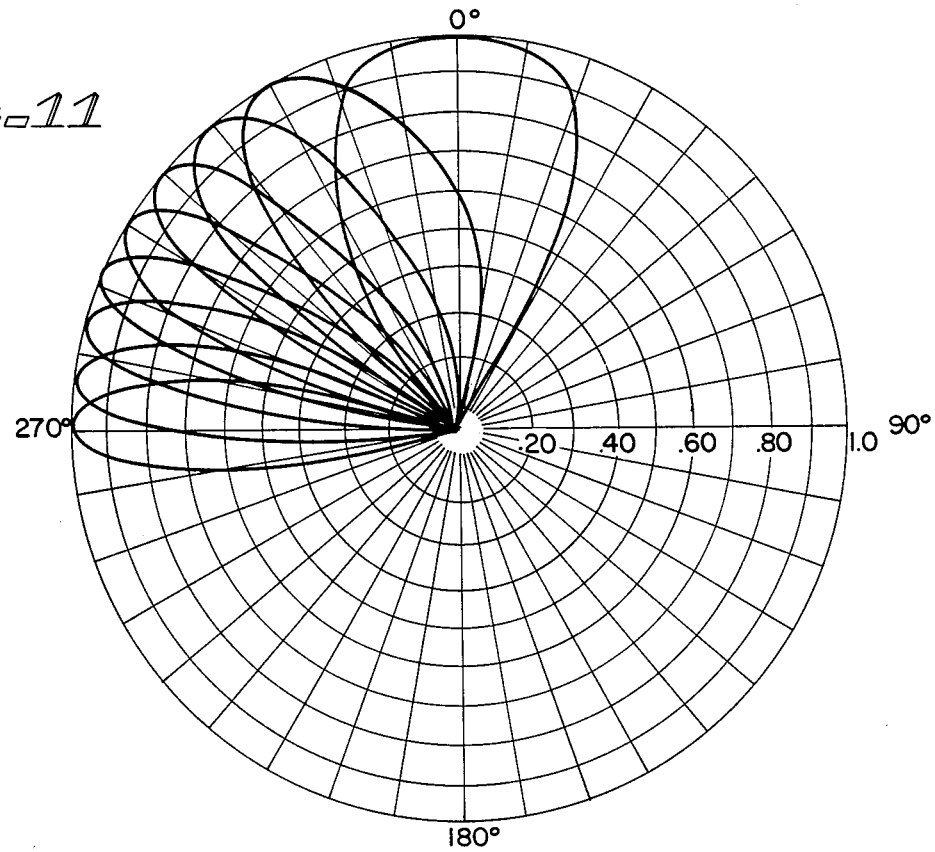
FIG. 11 is a graphical depiction of the horizontal radiation patterns of a modification of the sytem of FIGS. 6–9.

It will be understood that the spacing between the antennas of my line-array can be varied considerably with appropriate adjustment of other variables to provide similarly outstanding results. For example, FIG. 11 illustrates the radiation pattern obtained when the antenna spacing is reduced to one wavelength, using three antennas as shown in FIG. 6. The reduction in array gain is negligible, minor lobes all but disappear and each directional lobe is fattened to the extent that eight lobes fit a quadrant with excellent overlap.

Finally, to completely optimize the system, a minor adjustment in the antenna spacing can be optionally made to optimize the operation of the system when the antennas are firing precisely down the azimuth line. In this case, the spacing of the towers can be lengthened slightly in order for the advancing wave-front from each antenna to combine precisely with those of the other antennas at the take-off angle which is, in turn, dictated primarily by the antenna height and, to a minor extent, the unit antenna's gain. This optional adjustment is depicted in FIG. 6 which shows the optimum tower spacing and other dimensions for a three-antenna line-array constructed and operated in accordance with the invention at a design and center frequency of 3.8 MHz which, at an antenna height of $\frac{3}{4}$ wavelength yields a take-off angle of 18°. Under these conditions, the refined optimum antenna spacing is 2.1029λ, which yields an effective antenna spacing of exactly 2.0λ. A similar refinement of the system which yields the pattern of FIG. 11 produces a horizontal antenna spacing of 1.05λ.

Having described my invention in such terms as to enable those skilled in the art to understand and practice it and having depicted the presently preferred embodiments thereof, which are chosen for purposes of illustration and not by way of limitations on the scope thereof, I claim:

1. A radio transmission antenna system, comprising:

(a) an array of rotatable directional antennas, spaced apart S half-wavelengths at a characteristic design frequency, along a geographic azimuth line having a center, where S is a positive integer at least equal to 2;

(b) means for separately rotating said antennas to direct their respective major lobes along parallel lines in a selected direction relative to said azimuth line;

(c) means for providing first and second phase adjustments of the phase of identical rf signals fed to each antenna of said array, (i) a first phase adjustment of 180 electrical degrees in the phase of identical signals fed to adjacent antennas in the array, when required to produce a coherent wave-front in said selected direction, to establish radiation patterns, in a given azimuthal quadrant, which provide major lobes, established by rotating said antennas, at 0° and 90° relative to said azimuth line and at at least one intermediate angle therebetween, and (ii) a second phase adjustment in equal, opposite magnitudes of the signals fed to antennas spaced equally from the geographic center of said array, to electrically wobble the direction of the major lobe of said coherent wave-front established by said first adjustment.

2. A method of transmitting radio signals by an array of rotatable directional antennas spaced along a geographic azimuth line having a center, said array including means for separately rotating said antennas to direct their respective major lobes along parallel lines in a selected direction relative to said azimuth line, said method including the steps, in combination, comprising:

(a) spacing the individual antennas of said array apart by S half-wavelengths, where S is a positive integer at least equal to 2;

(b) adjusting the phase of separate identical rf signals fed to each antenna of said array by 180 electrical degrees difference in the phase of signals fed to adjacent antennas in said array, when required, to establish a radiation pattern in each given quadrant which includes major lobes established by rotating said antennas, said major lobes being located at 0° and 90° relative to said azimuth line and at least one intermediate angle therebetween; and (c) adjusting the phase of said separate identical rf signals by equal, opposite magnitudes between the signals fed to antennas spaced equally from the geographic center of said array, to wobble the direction of said major lobe either side of the directions thereof determined by the adjustment of step (b).

* * * * *